US009506618B2

(12) United States Patent
Sheu

(10) Patent No.: US 9,506,618 B2
(45) Date of Patent: Nov. 29, 2016

(54) AUTOMOTIVE LAMP SYSTEM

(71) Applicant: HON HAI PRECISION INDUSTRY CO., LTD., New Taipei (TW)
(72) Inventor: Yi-Zhong Sheu, New Taipei (TW)
(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 502 days.
(21) Appl. No.: 13/901,585
(22) Filed: May 24, 2013
(65) Prior Publication Data
US 2014/0177251 A1 Jun. 26, 2014
(30) Foreign Application Priority Data
Dec. 25, 2012 (TW) ..... 101149880 A
(51) Int. Cl.
*F21S 8/10* (2006.01)
(52) U.S. Cl.
CPC ..... *F21S 48/1757* (2013.01); *F21S 48/1154* (2013.01); *F21S 48/1388* (2013.01)
(58) Field of Classification Search
CPC ..... B60R 1/12; B60R 1/00; B60R 1/04; F21S 48/1159; F21S 48/1388; F21S 48/1104; F21S 48/13; F21S 48/1305; F21S 48/1109; F21S 48/24; F21S 48/1154; F21S 48/1742; F21S 48/1747; F21S 10/06; F21S 48/115; F21S 48/1757; F21S 48/1721; F21S 48/1768; F21S 48/1773; F21S 48/1794; B60Q 2400/40; B60Q 1/24; B60Q 1/04; B60Q 2400/30; B60Q 1/22; B60Q 1/2696; B60Q 1/28; B60Q 2300/112; B60Q 1/085; B60Q 2300/132; B60Q 2300/114; B60Q 1/10; B60Q 1/143; B60Q 2300/324; B60Q 2300/056; B60Q 2300/122; B60Q 2300/42; B60Q 1/076; B60Q 2300/32; B60Q 1/12; B60Q 2300/322; B60Q 1/0683; B60Q 1/08; B60Q 2200/38; B60Q 2300/41; B60Q 1/122; B60Q 2300/45; B60Q 2300/12; B60Q 2300/13; B60Q 2300/33; G06K 9/00798; G06K 9/00818; G06K 9/209; B62J 6/02; B29L 2031/30; F21W 2101/10; F21Y 2101/02; F21Y 2103/003; G02F 2201/34; G02F 1/133603; G02F 1/133605; G03B 21/2066; G02B 6/0038; G02B 6/0053; G02B 6/0055; G02B 6/0068; G02B 19/0061; F21K 9/50; F21L 4/027; F21V 14/04; F21V 21/06; F21V 19/02; B60G 2400/204; B60G 2400/82; B60W 40/076; B62K 5/05; F16H 25/20; G06T 7/004; G08G 1/165; G08G 1/166
See application file for complete search history.

(56) References Cited

U.S. PATENT DOCUMENTS 6,039,466 A * 3/2000 Duchenne ..... B60Q 1/068 362/284
2011/0305033 A1* 12/2011 Sugiyama ..... 362/512

FOREIGN PATENT DOCUMENTS

CN 1305629 A 7/2001
CN 1734159 A 2/2006

(Continued)

*Primary Examiner* — Stephen F Husar
*Assistant Examiner* — Danielle Allen
(74) *Attorney, Agent, or Firm* — Zhigang Ma

(57) ABSTRACT

An automotive lamp system adapted for providing illumination for a vehicle includes an LED, a controlling motor and a reflecting mirror module. The reflecting mirror module is connected to the controlling motor via a driving shaft. The reflecting mirror module includes a first reflecting mirror and a second reflecting mirror. The first reflecting mirror is configured for reflecting the light generated from the LED to the second reflecting mirror. The second reflecting mirror is configured for reflecting the light reflected by the first reflecting mirror outside the vehicle. An angle of the reflecting mirror module relative to the LED is varied via the controlling motor. Thus, a direction of the light reflected outside the vehicle is varied.

8 Claims, 4 Drawing Sheets

(56) References Cited

FOREIGN PATENT DOCUMENTS

| | | | |
|---|---|---|---|
| CN | 102278688 | A | 12/2011 |
| CN | 202140942 | U | 2/2012 |
| JP | 2006040407 | A | 2/2006 |

* cited by examiner

AUTOMOTIVE LAMP SYSTEM

BACKGROUND

1. Technical Field

The disclosure relates to an illumination system, and particularly to an automotive lamp system applied in a vehicle for providing adjustable illumination scope.

2. Description of Related Art

Nowadays, light emitting diodes (LEDS) are widely used as light sources of an automotive lamp system in a vehicle. A conventional automotive lamp system may only include a single group of LEDs and one reflecting mirror. The reflecting mirror is configured for reflecting light generated from the LEDs out of the vehicle. Since the single group of the LEDs and the reflecting mirror are mounted at a fixed position and a fixed angle, and the LEDs and the reflecting mirror are not movable to adjust to different positions and angles. The single group of the LEDs and the reflecting mirror can only be irradiated toward a single direction and a fixed distance, the illumination range is limited. In order to meet illumination demands of different directions and different distances, more than two traditional automotive lamp systems need to be mounted at different positions and angles.

What is needed, therefore, is an automotive lamp system which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
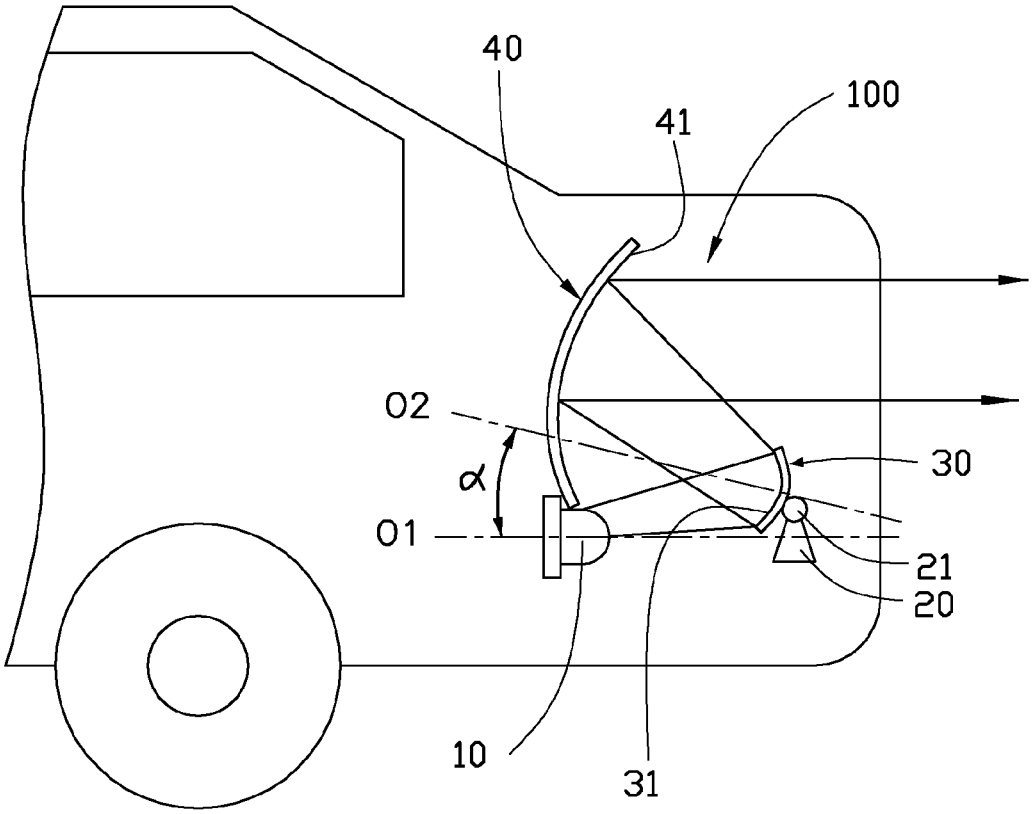
FIG. 1 is a schematic view of an automotive lamp system in accordance with a first embodiment of the disclosure, in which the automotive lamp system is in a first state.

Referring to FIG. 1, an automotive lamp system 100 in accordance with a first embodiment of the disclosure is shown. The automotive lamp system 100 is disposed in a front portion of a vehicle for illuminating a road in front of the vehicle. The automotive lamp system 100 includes an LED 10, a controlling motor 20 and a reflecting mirror module. The reflecting mirror module includes a first reflecting mirror 30 and a second reflecting mirror 40.

The LED 10 is electrically connected with a storage battery in the vehicle to obtain electrical energy from the storage battery. The LED 10 irradiates light toward the first reflecting mirror 30.

The first reflecting mirror 30 is configured for reflecting the light generated from the LED 10 to the second reflecting mirror 40. The first reflecting mirror 30 is arc-shaped and includes a concave first reflecting face 31. The first reflecting face 31 is bent opposite to the front portion of the vehicle and faces light emitting direction of the LED 10. Specifically, the first reflecting face 31 of the first reflecting mirror 30 is located at an oblique upper front of the LED 10.

The second reflecting mirror 40 is configured for reflecting the light reflected by the first reflecting mirror 30 outside the vehicle. The second reflecting mirror 40 is arc-shaped and includes a concave second reflecting face 41. The second reflecting face 41 has a surface area larger than that of the first reflecting face 31 of the first reflecting mirror 30. The second reflecting mirror 40 is substantially located directly above the LED 10. The second reflecting face 41 faces the front portion of the vehicle and the first reflecting face 31 of the first reflecting mirror 30.

Figure 2:
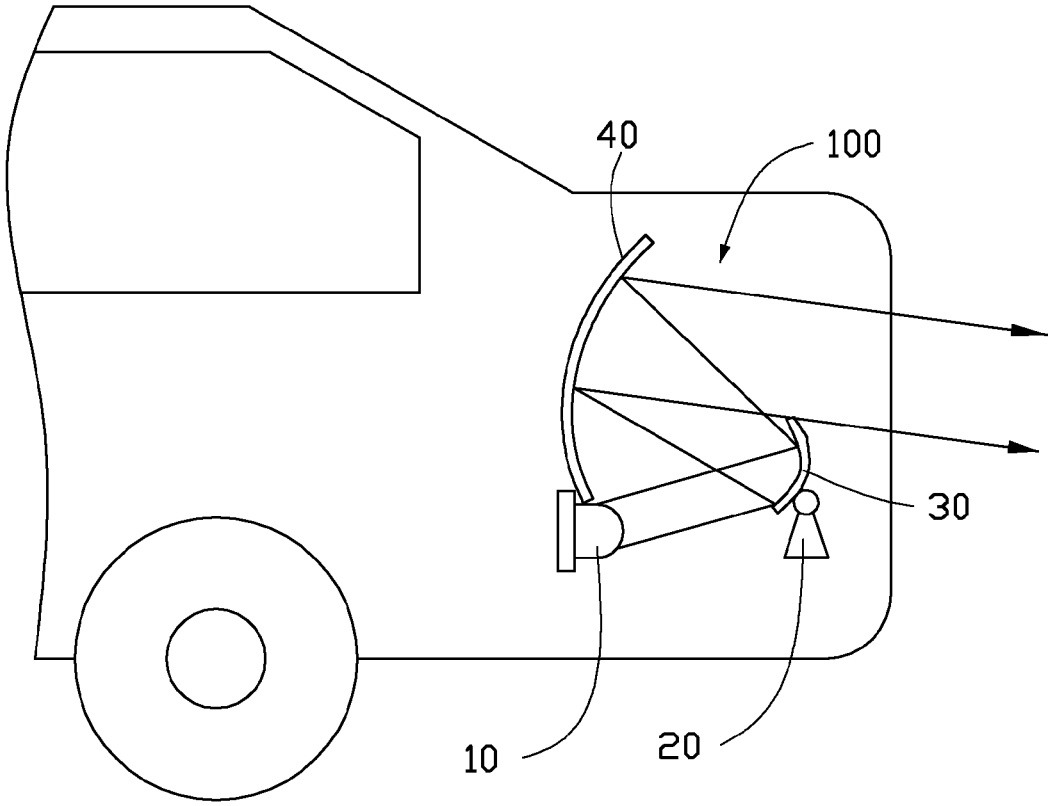
FIG. 2 is another schematic view of the automotive lamp system of FIG. 1, in which the automotive lamp system is in a second state.

The controlling motor 20 includes a driving shaft 21. The first reflecting mirror 30 is pivotally connected with the controlling motor 20 via the driving shaft 21. Here, an angle $\alpha$ of the first reflecting mirror 30 relative to the LED 10 is defined by an angle between a central axis O1 of the LED 10 and a focusing axis O2 of the first reflecting mirror 30. The angle $\alpha$ of the first reflecting mirror 30 relative to the LED 10 is varied when the driving shaft 21 of the controlling motor 20 rotates, thus the positions of the first reflecting mirror 30 on which the light generated from the LED 10 irradiates are varied, and then the directions of the light reflected by the first reflecting mirror 30 to the second reflecting mirror 40 are varied. Accordingly, an illuminating area of the automotive lamp system 100 can be controlled by changing the angle $\alpha$ of the first reflecting mirror 30 relative to the LED 10. Referring to FIG. 1, the light generated from the automotive lamp system 100 can be irradiated toward a far area of the road in front of the vehicle. Referring to FIG. 2, when the angle $\alpha$ of the first reflecting mirror 30 relative to the LED 10 is varied, the light generated from the automotive lamp system 100 can be irradiated toward a near area of the road in front of the vehicle.

Figure 3:
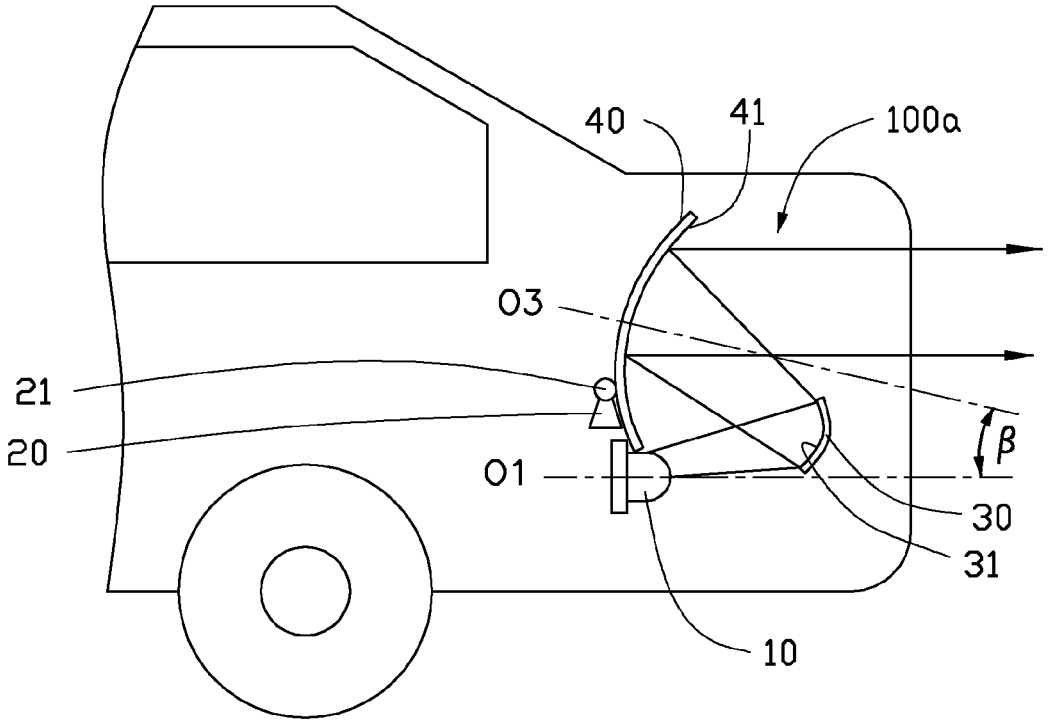
FIG. 3 is a schematic view of an automotive lamp system in accordance with a second embodiment of the disclosure, in which the automotive lamp system is in a first state.

Referring to FIG. 3, an automotive lamp system **100*a* in accordance with a second embodiment of the disclosure is shown. The automotive lamp system 100*a* includes an LED 10, a controlling motor 20 and a reflecting mirror module. The reflecting mirror module includes a first reflecting mirror 30 and a second reflecting mirror 40. The first reflecting mirror 30 includes a concave first reflecting face 31. The second reflecting mirror 40 includes a concave second reflecting face 41. The controlling motor 20 includes a driving shaft 21**.

Figure 4:
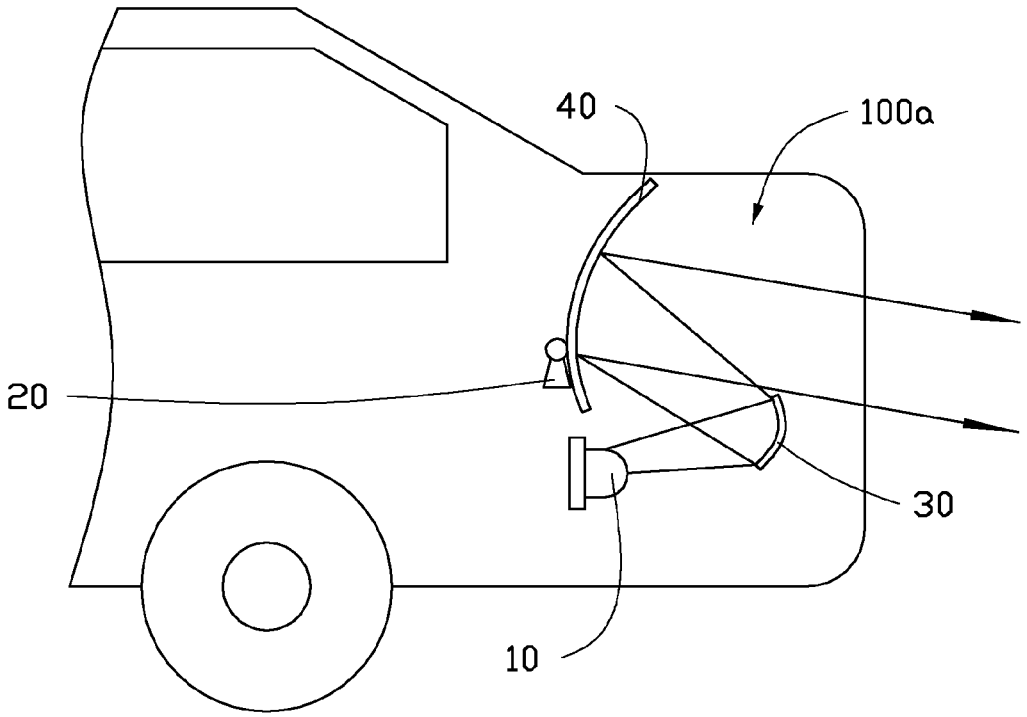
FIG. 4 is another schematic view of the automotive lamp system of FIG. 3, in which the automotive lamp system is in a second state.

The differences between the automotive lamp system 100 of the first embodiment and the automotive lamp system **100*a* of the second embodiment are in that: the second reflecting mirror 40 is pivotally connected with the controlling motor 20 via the driving shaft 21. Here, an angle $\beta$ of the second reflecting mirror 40 relative to the LED 10 is defined by an angle between a central axis O1 of the LED 10 and a focusing axis O3 of the second reflecting mirror 40. The angle $\beta$ of the second reflecting mirror 40 relative to the LED 10 is varied when the driving shaft 21 of the controlling motor 20 rotates, thus the positions of the second reflecting mirror 40 to which the light is reflected by the first reflecting mirror 30 are varied, and then the directions of the light reflected outside the vehicle by the second reflecting mirror 40 are varied. Accordingly, an illuminating area of the automotive lamp system 100*a* can be controlled by changing the angle $\beta$ of the second reflecting mirror 40 relative to the LED 10. Referring to FIG. 3, the light generated from the automotive lamp system 100*a* can be irradiated toward a far area of the road in front of the vehicle. Referring to FIG. 4, when the angle β of the second reflecting mirror 40 relative to the LED 10 is varied, the light generated from the automotive lamp system 100***a* can be irradiated toward a near area of the road in front of the vehicle.

It is believed that the disclosure and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An automotive lamp system for providing illumination for a vehicle, comprising:

a light emitting diode (LED);

a controlling motor comprising a driving shaft; and a reflecting mirror module comprising a first reflecting mirror and a second reflecting mirror, the first reflecting mirror being located at an oblique upper front of the LED, the second reflecting mirror being located directly above the LED, the first reflecting mirror reflecting light from the LED to the second reflecting mirror, the second reflecting mirror reflecting light out of the automotive lamp system, the first reflecting mirror being pivotally connected with the controlling motor via the driving shaft, the controlling motor is adapted to move the first reflecting mirror and to adjust an angle between the first reflecting mirror and the LED whereby adjusting a direction of the light reflected out of the automotive lamp system;

wherein the angle of the first reflecting mirror relative to the LED is varied when the driving shaft of the controlling motor rotates.

2. The automotive lamp system of claim 1, wherein the first reflecting mirror is arc-shaped and comprises a first reflecting face, the first reflecting face being concave and facing a light emitting direction of the LED.

3. The automotive lamp system of claim 2, wherein the second reflecting mirror is arc-shaped and comprises a second reflecting face, the second reflecting face being concave and facing the first reflecting face of the first reflecting mirror.

4. The automotive lamp system of claim 3, wherein the second reflecting face has a surface area larger than a surface area of the first reflecting face of the first reflecting mirror.

5. An automotive lamp system for providing illumination for a vehicle, comprising:

a light emitting diode (LED);

a controlling motor comprising a driving shaft; and a reflecting mirror module comprising a first reflecting mirror and a second reflecting mirror, the first reflecting mirror being located at an oblique upper front of the LED, the second reflecting mirror being located directly above the LED, the first reflecting mirror reflecting light from the LED to the second reflecting mirror, the second reflecting mirror reflecting light out of the automotive lamp system, the second reflecting mirror being pivotally connected with the controlling motor via the driving shaft, the controlling motor is adapted to move the second reflecting mirror and to adjust an angle between the second reflecting mirror and the LED whereby adjusting a direction of the light reflected out of the automotive lamp system;

wherein the angle of the second reflecting mirror relative to the LED is varied when the driving shaft of the controlling motor rotates.

6. The automotive lamp system of claim 5, wherein the first reflecting mirror is arc-shaped and comprises a first reflecting face, the first reflecting face being concave and facing a light emitting direction of the LED.

7. The automotive lamp system of claim 6, wherein the second reflecting mirror is arc-shaped and comprises a second reflecting face, the second reflecting face being concave and facing the first reflecting face of the first reflecting mirror.

8. The automotive lamp system of claim 7, wherein the second reflecting face has a surface area larger than a surface area of the first reflecting face of the first reflecting mirror.

* * * * *